United States Patent [19]

Young

[11] 4,021,241

[45] May 3, 1977

[54] DIFFUSION TRANSFER PROCESSING SOLUTIONS WITH CARBOXYMETHYL HYDROXYETHYL CELLULOSE

[75] Inventor: Richard W. Young, Wellesley Hills, Mass.

[73] Assignee: Polaroid Corporation, Cambridge, Mass.

[22] Filed: Mar. 10, 1976

[21] Appl. No.: 665,518

Related U.S. Application Data

[63] Continuation of Ser. No. 460,599, April 12, 1974, abandoned, which is a continuation-in-part of Ser. No. 272,412, July 17, 1972, abandoned, which is a continuation-in-part of Ser. No. 148,590, June 1, 1971, abandoned.

[52] U.S. Cl. ..... 96/29 D; 96/3; 96/66 R; 96/76 C; 96/77; 106/193 J; 106/197 C; 106/197 R

[51] Int. Cl.[2] ..... G03C 7/00; G03C 5/54; G03C 1/48; G03C 1/40

[58] Field of Search ..... 96/66 R, 3, 29 D, 77, 96/76 C, 76 R; 106/197 R, 193 J, 197 C

[56] References Cited

UNITED STATES PATENTS

| | | | |
|---|---|---|---|
| 3,266,894 | 8/1966 | Weyerts et al. | 96/3 |
| 3,415,646 | 12/1968 | Land | 96/3 |
| 3,619,155 | 11/1971 | Young | 96/3 |
| 3,647,437 | 3/1972 | Land | 96/3 |
| 3,832,175 | 8/1974 | Kemp | 96/29 L |

*Primary Examiner*—David Klein
*Assistant Examiner*—Richard L. Schilling
*Attorney, Agent, or Firm*—Philip G. Kiely

[57] ABSTRACT

The present invention relates to photography and, more particularly, to diffusion transfer process photographic film units which comprise a photosensitive element adapted to provide, by diffusion transfer photographic processing, selective dyde image recordation of incident actinic radiation as a function of the point-to-point degree of photosensitive element exposure, which film unit includes a plurality of essential layers including a photosensitive silver halide layer having associated therewith dye image-forming material which is diffusible during processing as a function of the point-to-point degree of silver halide layer exposure to incident actinic radiation and a layer adapted to receive image-forming material diffusing thereto; means for applying an aqueous composition therebetween, said composition comprising 0.1-10%, by weight, of a viscosity increasing polymer comprising carboxymethyl hydroxyethyl cellulose. Optionally, said composition also includes titanium dioxide in a ratio of 1 to 10 g. of titanium dioxide per 0.1 g. of polymer.

11 Claims, 7 Drawing Figures

DIFFUSION TRANSFER PROCESSING SOLUTIONS WITH CARBOXYMETHYL HYDROXYETHYL CELLULOSE

CROSS REFERENCE TO RELATED APPLICATIONS

This application is a continuation of application Ser. No. 460,599, filed Apr. 12, 1974 and now abandoned, which is a continuation-in-part of application Ser. No. 272,412, filed July 17, 1972, now abandoned, which in turn is a continuation-in-part of application Ser. No. 148,590 filed June 1, 1971 now abandoned.

BACKGROUND OF THE INVENTION

1. Field of the Invention

The present invention is directed to providing new and improved diffusion transfer process photographic film units adapted to provide, as a function of the point-to-point degree of photoexposure, by diffusion transfer processing a dye transfer image.

2. Description of Prior Art

As disclosed in U.S. Pat. No. 3,415,644, a composite photosensitive structure, particularly adapted for reflection type photographic diffusion transfer color process employment, which comprises a plurality of essential layers including, in sequence, a dimensionally stable opaque layer; one or more silver halide emulsion layers having associated therewith dye image-providing material which is soluble and diffusible, in alkali, at a first pH, as a function of the point-to-point degree of its associated silver halide emulsion's exposure to incident actinic radiation; a polymeric layer adapted to receive solubilized dye image-providing material diffusing thereto; a polymeric layer containing sufficient acidifying capacity to effect reduction of a processing composition from the first pH to a second pH at which the dye image-providing material is substantially nondiffusible; and a dimensionally stable transparent layer, may be exposed to incident actinic radiation and processed by interposing, intermediate the silver halide emulsion layer and the reception layer, an alkaline processing composition possessing the first pH and containing light reflecting pigment, which may reflect incident radiation, in a quantity sufficient to mask dye image-providing material associated with the silver halide emulsion.

In a preferred embodiment, the composite photosensitive structure includes a rupturable container, retaining the alkaline processing composition having the first pH and light reflecting pigment, fixedly positioned extending transverse a leading edge of the composite structure in order to effect, upon application of compressive pressure to the container, discharge of the processing composition intermediate the opposed surfaces of the reception layer and the next adjacent silver halide emulsion.

The liquid processing composition, distributed intermediate the reception layer and the silver halide emulsion, permeates the silver halide emulsion layers of the composite photosensitive structure to initiate development of the latent images contained therein resultant from photoexposure. As a consequence of the development of the latent images, dye image-providing material associated with each of the respective silver halide emulsion layers is individually mobilized as a function of the point-to-point degree of the respective silver halide emulsion layer's photoexposure, resulting in imagewise distributions of mobile dye image-providing materials adapted to transfer, by diffusion, to the reception layer to provide the desired transfer dye image. Subsequent to substantial dye image formation in the reception layer, a sufficient portion of the ions of the alkaline processing composition transfers, by diffusion, to the polymeric neutralizing layer to effect reduction in the alkalinity of the composite film unit to the second pH at which dye image-providing material is substantially nondiffusible, and further dye image-providing material transfer is thereby substantially obviated.

The transfer dye image is viewed, as a reflection image, through the dimensionally stable transparent layer against the background provided by the light reflecting pigment distributed as a component of the processing composition, intermediate the reception layer and next adjacent silver halide emulsion layer. The thus-formed light reflecting stratum effectively masks residual dye image-providing material retained in association with the silver halide emulsion layer subsequent to processing.

In U.S. Pat. No. 3,415,646, the dimensionally stable layer of the film unit next adjacent the photosensitive silver halide layer or layers is disclosed to be transparent to incident actinic radiation and as disclosed in U.S. Pat. No. 3,415,645, in such instance the light reflecting pigment may be initially disposed in the film unit intermediate the reception layer and next adjacent silver halide layer.

As disclosed in U.S. Pat. No. 3,615,421 of Edwin H. Land, issued Oct. 26, 1971, and U.S. Pat. No. 3,661,585 of Sheldon A. Buckler, issued May 9, 1972, the light-reflecting component of the film unit may optionally be initially disposed as a preformed processing composition permeable layer, intermediate the reception layer and next adjacent silver halide layer, in a concentration which prior to photoexposure is insufficient to prevent transmission therethrough of exposing actinic radiation and which, subsequent to processing, possesses an opacifying capacity effective to mask residual dye image-providing material retained associated with the film unit's silver halide emulsion layers, and in U.S. Pat. No. 3,647,435 of Edwin H. Land, issued Mar. 7, 1972, the opacifying component of the film unit may optionally be initially formed in situ, intermediate the reception layer and next adjacent silver halide layer, during photographic processing of the film unit.

In the copending U.S. Pat. applications of Edwin H. Land, Ser. No. 786,352, filed Dec. 23, 1968, now abandoned, and Ser. No. 43,782, filed June 5, 1970, now abandoned, the opacifying component is disclosed to optionally comprise a light-absorbing at the first pH and which may be converted to a substantially non-absorbing species at the second pH, and in U.S. Pat. No. 3,473,925 and the U.S. Pat. Nos. 3,573,042 issued Mar. 30, 1971 and 3,576,626 issued Apr. 27, 1971 of Terry W. Milligan and Richard W. Young, disclosing opacifying and reflecting component, respectively, may be individually interposed intermediate the silver halide layer and reception layer by selective distribution from a composite or a pluality of rupturable containers.

In the U.S. Pat. No. 3,573,043 of Edwin H. Land, issued Mar. 30, 1971, the polymeric neutralizing layer is disclosed to be optionally disposed intermediate the dimensionally stable opaque layer and next adjacent essential layer, i.e., next adjacent silver halide/dye image-providing material component, to effect the designated modulation of film unit's environmental pH; the U.S. Pat. No. 3,576,625 of Edwin H. Land issued Apr. 27, 1971, discloses the employment of particulate acid distributed within the film unit to effect the modulation of the environmental pH, and the U.S. Pat. No. 3,573,044 of Edwin H. Land, issued Mar. 30, 1971, discloses the employment of processing composition solvent vapor transmissive dimensionally stable layers to effect process modulation of dye transfer as a function of solvent concentration.

Where desired, the film unit may also be constructed in accordance with the disclosure of U.S. Pat. Nos. 3,594,165 issued July 20, 1971 and 3,594,164 issued July 20, 1971, both of Howard G. Rogers, to comprise a composite photosensitive structure including a transparent dimensionally stable layer carrying a reception layer, a processing composition permeable opaque layer and a photosensitive silver halide layer and the film unit may include a separate dimensionally stable sheet element adapted to be superposed on the surface of the photosensitive structure opposite the dimensionally stable layer and may further include a rupturable container retaining processing composition and adapted to distribute the composition intermediate the sheet and photosensitive structure to effect processing. As further disclosed in the last-cited applications, in structures wherein the receptor is positioned next adjacent the transparent layer or the processing composition and/or the sheet is to be separated from the remainder of the film unit subsequent to processing, the latter elements may optionally include opacifying component.

As dislosed in the U.S. Pat. No. 3,620,724 issued Nov. 16, 1971 of Edwin H. Land and the copending U.S. Pat. application Ser. No. 3691 of Sheldon A. Buckler, filed Jan. 19, 1970, now abandoned, the dimensionally stable layer referred to may be opaque and in which instance the photosensitive silver halide layer is positioned next adjacent the opaque support layer and the opacifying component of the film unit's processing composition permeable opaque layer will be disposed in the unit in a concentration insufficient to prevent transmission therethrough of exposing actinic radiation and which, subsequent to processing, possesses an opacifying capacity effective to mask residual dye image-providing material retained associated with the silver halide layer, and as disclosed in the U.S. Pat. No. 3,647,434 of Edwin H. Land, issued Mar. 7, 1972, the opacifying agent may be optionally formed in such film unit, in situ, during processing of the unit.

SUMMARY OF THE INVENTION

The present invention is directed to a new and improved, preferably integral negative/positive, diffusion transfer process photographic film unit adapted to provide, by diffusion transfer processing, photographic color image reproduction as a function of exposure of such film unit to incident actinic radiation.

The film unit assemblage construction to be employed in the practice of the present invention preferably comprises a film unit of the general type set forth in aforementioned U.S. Pat. Nos. 3,415,644, –5 and –6 and 3,473,925 and copending U.S. Pat. applications Ser. Nos. 786,352; 3691; and 43,782; and U.S. Pat. Nos. 3,573,043; 3,573,044; 3,573,042; 3,614,421; 3,576,625; 3,576,626; 3,620,724; 3,594,165; 3,594,164; 3,647,434; 3,647,435; and in 2,983,606 and 3,345,163; and will include a photosensitive silver halide layer disposed in a photosensitive element which contains a plurality of layers including, in relative order, a dimensionally stable layer preferably opaque to incident actinic radiation; one or more photosensitive silver halide layers having associated therewith dye image-forming material which is processing composition diffusible as a function of the point-to-point degree of silver halide layer exposure to incident actinic radiation; a layer adapted to receive image-forming material diffusing thereto; a dimensionally stable layer transparent to incident actinic radiation; and a rupturable container retaining an aqueous processing composition and adapted to discharge said processing composition intermediate said silver halide layers and the reception layer; said composition comprising 0.1–10%, by weight, of a viscosity increasing polymer comprising carboxymethyl hydroxyethyl cellulose. In a preferred embodiment, the composition also includes titanium dioxide pigment in a ratio of 1 to 10 g. of titanium dioxide per 0.1 g. of polymer, and in a particularly preferred embodiment, said processing composition possessing a first pH at which the dye image-forming material is diffusible during processing and means for modulating the pH of the film unit from the first pH to a second pH at which the dye image-forming material is substantially nondiffusible subsequent to substantial dye transfer image formation. If the film unit is intended to remain intact subsequent to processing, it is preferred that the titanium dioxide pigment be employed. However, if the layer adapted to receive the image-forming material is detached subsequent to processing, the pigment may be omitted.

In accordance with a specifically preferred embodiment of the present invention, a film unit assemblage of the aforementioned general structural parameters will be adapted to be processed, subsequent to photoexposure, in the presence of actinic radiation and may be fabricated to employ, as means interposed intermediate the reception layer and next adjacent silver halide layer subsequent to photoexposure, the above-described viscosity increasing polymer and optionally light-reflecting pigment and at least one optical filter agent, at a pH above the pKa of the optical filter agent and at which pH the dye image-forming material is diffusible during processing as a function of silver halide layer photoexposure, in a concentration in admixture effective to provide a barrier to transmission of actinic radiation therethrough.

BRIEF DESCRIPTION OF THE DRAWINGS

FIGS. 2, 4 and 6 are diagrammatic enlarged crosssectional views of the film unit of FIG. 1, along section line 2—2, illustrating the association of elements during the three illustrated stages of the performance of a diffusion transfer process, for the production of a multicolor transfer image according to the invention, the thickness of the various materials being exaggerated, and wherein FIG. 2 represents an exposure stage, FIG. 4 represents a processing stage and FIG. 6 represents a product of the process.

DETAILED DESCRIPTION OF THE INVENTION

Figure 1:
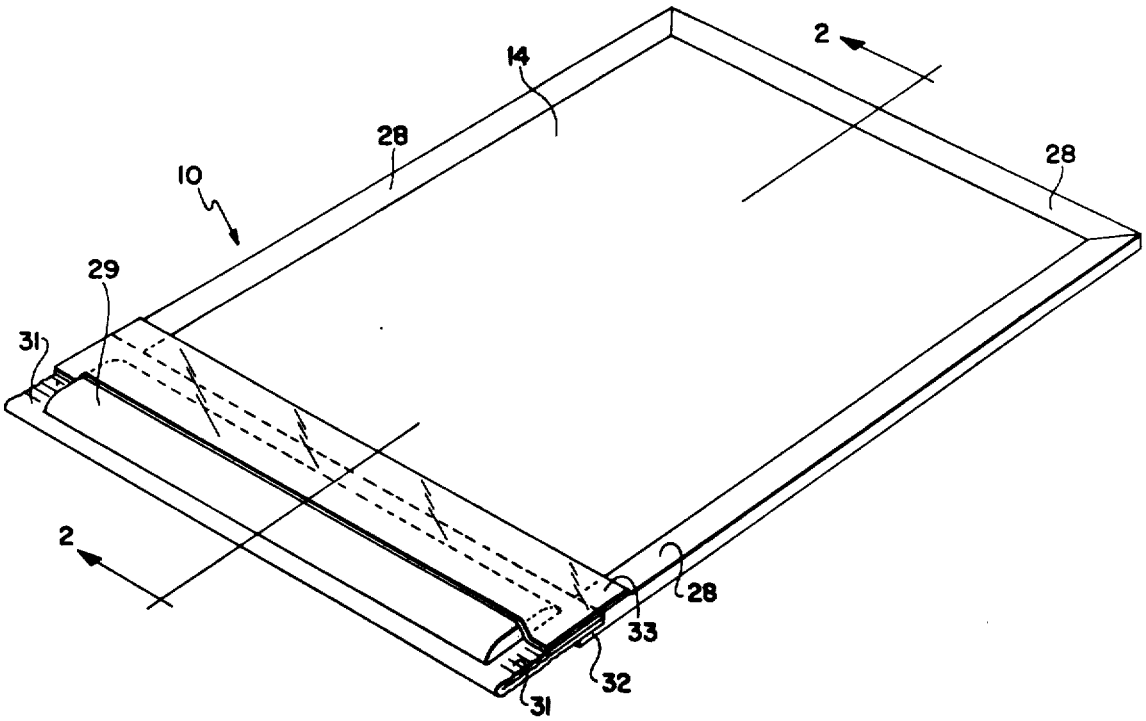
FIG. 1 is a perspective view of a photographic film unit embodying the invention.

As previously characterized, diffusion transfer photographic processing may be employed to provide a positive reflection dye image, as a direct function of actinic radiation incident on a film unit assemblage which unit is preferably constructed to comprise a plurality of sequential layers including a dimensionally stable layer most preferably opaque to incident radiation; a photosensitive silver halide layer having associated therewith dye image-forming material which is processing composition diffusible at a selected first pH as a function of the point-to-point degree of silver halide layer photoexposure; a layer adapted to receive dye image-forming material diffusing thereto; a dimensionally stable layer transparent to incident radiation; means for interposing, intermediate the silver halide layer and the reception layer, opacifying agent and preferably an inorganic reflecting pigment dispersion containing at least one optical filter agent or dye in a concentration effective to provide, subsequent to selective photoexposure of the silver halide layer, protection of the silver halide layer from further exposure to actinic radiation incident on the dimensionally stable layer; means for converting the pH of the film unit from the first pH to a second pH at which the dye image-forming material is substantially nondiffusible subsequent to substantial dye image-forming material diffusion to the reception layer; and wherein the dimensionally stable layers, taken together, possess a processing composition solvent vapor permeability adapted to effect, subsequent to substantial dye transfer image formation and preceding substantial dye transfer image degradation, osmotic transpiration of processing composition solvent in a quantity effective to decrease a first solvent concentration at which the dye image-forming material is soluble and diffusible as a function of processing to a second solvent concentration at which the dye image-forming material is substantially nondiffusible.

It now has been discovered, however, that improved photographic reproduction in color by diffusion transfer processing may be accomplished by employment of a diffusion transfer process film unit which comprises a plurality of sequential layers including a dimensionally stable layer preferably opaque to incident radiation; a photosensitive silver halide layer having associated therewith dye image-forming material which is processing composition diffusible at a selected first pH as a function of the point-to-point degree of silver halide layer photoexposure; a layer adapted to receive dye image-forming material diffusing thereto; a dimensionally stable layer transparent to incident radiation; a rupturable container retaining an aqueous processing composition and adapted to discharge said processing composition intermediate said silver halide layer and the reception layer, said aqueous processing composition comprising 0.1 to 10%, by weight, of a viscosity increasing polymer comprising carboxymethyl hydroxyethyl cellulose and titanium dioxde pigment in a ratio of 1 to 10 g. of titanium dioxide per 0.1 g. of polymer. In a preferred embodiment, the processing composition also includes an alkali metal hydroxide.

The rupturable container is preferably fixedly positioned and extends transverse a leading edge of the film unit to effect, upon application of compressive pressure, discharge of the processing composition intermediate the reception layer and the photosensitive layer next adjacent.

The titanium dioxide pigment is preferably employed at a level of about 15 g. per gram of polymer. Upon discharge of the contents of the rupturable container, a layer distributed intermediate said silver halide layers and said reception layer preferably possesses hiding power, as measured by contrast ratio, in excess of about 0.9, more preferably 0.95, as measured by reflection measurement of said layer over a black surface as compared with said layer over a white surface. The contrast ratio designation is conventional in the art.

Carboxymethyl hydroxyethyl cellulose (CMHEC) polymers are compounds known to those skilled in the art and may be obtained commercially. These cellulose derivatives may be generally illustrated by the formula:

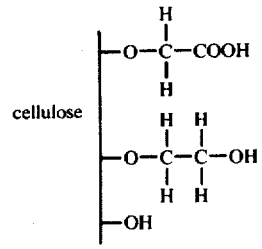

In the above formula, a simple line structure has been employed for designating the anhydroglucose unit of cellulose, which unit contains three reactive hydroxyl groups. The hydrogen atoms of one or more of such hydroxyl groups may be replaced with the carboxymethyl radical, as shown in the upper position in the formula, or by the hydroxyethyl radical as shown in the middle position. The last position in the above formula is shown as the unreplaced hydroxyl group.

The hydrogen atom of each hydroxyl group can be replaced by only one carboxymethyl radical; however, the ethylene oxide employed to introduce the hydroxymethyl radical can either react at the hydroxyls of the anhydroglucose unit to replace the hydrogen with one hydroxyethyl radical, or polymerize to form a side chain, e.g., $-CH_2CH_2OCH_2CH_2OH$, by reacting with hydroxyethyl radicals previously introduced. In typical CMHEC polymers contemplated for the practice of the present invention, the average number of reactive hydroxyl groups which have been substituted with carboxymethyl groups is in the range from about 0.2 to about 1.2; and the average number of moles of ethylene oxide that have become attached to the anhydroglucose unit in the two ways just described is in the range from about 2.0 to 3.5. A particularly useful CMHEC polymer, available from Hercules, Inc. under the designation SPX 1073, has an average of 0.34 hydroxyl groups substituted with carboxymethyl groups and an average of 2.13 moles of ethylene oxide attached to the anhydroglucose unit.

Preferred CMHEC polymers have viscosities from about 1000 cps to about 4000 cps in a 1% (by weight) aqueous solution at 25 C. Sufficient CMHEC is used in the processing composition to impart thereto a viscosity of at least about 5000 cps to greater than about 100,000 cps and sometimes up to about 200,000 cps. Concentrations of the CMHEC polymer in the processing composition in a particularly preferred embodiment range from about 2% to about 5% (weight/volume). A weight/volume percentage is herein defined as one based on the weight of polymer divided by the volume of solvent.

The designation of substitution is conventional in the art. Viscosity is determined on a 1% aqueous solution of the polymeric material on a Brookfield Viscosimeter Model RVT, using a No. 4 spindle at 50 R.P.M. and at a temperature of 25° C. The polymeric material is prepared for testing by charging the dry polymer to a kettle, agitating with 20 psi of air pressure. After agitation for 10 minutes, the temperature is increased to 95° C. and agitated at 50 psi. After the temperature reaches 95° C., agitation is decreased to 40 psi and mixing contained for 1 hour. The solution is then cooled to 25° C. and held at that temperature without agitation for 45 minutes before the viscosity determination.

It should be understood that the term "carboxymethyl hydroxethyl cellulose" is intended to include the water-soluble salts thereof.

In general, the amount of substituted cellulose polymer utilized herein will be determined empirically. It has been found that, as a rule, a sufficient concentration of polymeric material to provide a continuous layer possessing a thickness of approximately 20 microns will suffice to provide the desired functionality to the system including the above-described measure of opacity.

Substituted cellulose polymers have been found to provide enhanced properties to the processing composition with respect to its disposition in the rupturable container and the discharge of the contents of said container.

Specifically, relatively high dispersion stability or storage is achieved; that is, the ability of the polymer to retain the titanium dioxide pigment in suspension without separation or settling substantially without change over a relatively long storage period. Further, substantially no interaction or degradation of the polymer occurs in the container which could cause undesirable discoloration or by-products detrimental to the photographic system.

The titanium dioxide pigment is preferably 0.15 to 0.5 and, more preferably, 0.2 to 0.3 microns in diameter.

Multicolor images may be obtained using color image-forming components in the diffusion transfer process of the present invention by several techniques. One such technique contemplates obtaining multicolor transfer images utilizing, for example, dye developers as dye image-providing materials by employment of an integral multilayer photosensitive element, such as is disclosed in my aforementioned U.S. Pat. No. 3,415,644 wherein at least two selectively sensitized photosensitive strata, superposed on a single support, are processed, simultaneously and without separation, with a single, common image-receiving layer. A suitable arrangement of this type comprises the opaque support carrying a red-sensitive silver halide stratum, a green-sensitive silver halide stratum and a blue-sensitive silver halide stratum, said emulsions having associated therewith, respectively, for example, a cyan dye developer, a magenta dye developer and a yellow dye developer. The dye developer may be utilized in the silver halide stratum, for example, in the form of particles, or it may be employed as a layer behind the appropriate silver halide strata. Each set of silver halide strata and associated dye developer strata are disclosed to be optionally separated from other sets by suitable interlayers, for example, by a layer of gelatin or polyvinyl alcohol. In certain instances, it may be desirable to incorporate a yellow filter in front of the green-sensitive emulsion and such yellow filter may be incorporated in an interlayer. However, where desirable, a yellow dye developer of the appropriate sepectral characteristics and present in a state capable of functioning as a yellow filter may be employed. In such instances, a separate yellow filter may be omitted.

In a preferred embodiment of the present invention, the film unit is specifically adapted to provide for the production of a multicolor dye transfer image and the photo-sensitive laminate comprises, in order of essential layers, the dimensionally stable opaque layer; at least two selectively sensitized silver halide strata each having dye image-providing material of predetermined color associated therewith, for example, dye developers as detailed above, which are soluble and diffusible in processing composition as a function of the point-to-point degree of exposure of the respective associated silver halide stratum; a polymeric layer dyeable by the dye image-providing materials; and a dimensionally stable transparent layer.

In view of the fact that the preferred dye image-providing materials comprise dyes which are silver halide developing agents, as stated above, for purposes of simplicity and clarity, the present invention will be further described hereinafter in terms of such dyes, without limitation of the invention to the illustrative dyes denoted, and, in addition the photographic film unit structure will be detailed hereinafter employing the last-mentioned preferred structural embodiment, without limitation of the invention to the preferred structure denoted.

Multicolor images may be obtained using color image-forming components in the diffusion transfer process of the present invention by several techniques. On such technique contemplates obtaining multicolor transfer images utilizing, for example, dye developers as dye image-providing materials by employment of an integral multilayer photosensitive element, such as is disclosed in aforementioned U.S. Pat. No. 3,415,644 wherein at least two selectively sensitized photosensitive strata, superposed on a single support, are processed, simultaneously and without separation, with a single, common image-receiving layer. A suitable arrangement of this type comprises the opaque support carrying a red-sensitive silver halide stratum, a green-sensitive silver halide stratum and a blue-sensitive silver halide stratum, said emulsions having associated therewith, respectively, for example, a cyan dye developer, a magenta dye developer and a yellow dye developer. The dye developer may be utilized in the silver halide stratum, for example, in the form of particles, or it may be employed as a layer behind the appropriate silver halide strata. Each set of silver halide strata and associated dye developer strata are disclosed to be optionally separated from other sets by suitable interlayers, for example, by a layer of gelatin or polyvinyl alcohol. In certain instances, it may be desirable to incorporate a yellow filter in front of the green-sensitive emulsion and such yellow filter may be incorporated in an interlayer. However, where desirable, a yellow dye developer of the appropriate spectral characteristics and present in a state capable of functioning as a yellow filter may be employed. In such instances, a separate yellow filter may be omitted.

In a preferred embodiment of the present invention, the film unit is specifically adapted to provide for the production of a multicolor dye transfer image and the photosensitive laminate comprises, in order of essential layers, the dimensionally stable opaque layer; at least two selectively sensitized silver halide strata each having dye image-providing material of predetermined color associated therewith, for example, dye developers as detailed above, which are soluble and diffusible in processing composition as a function of the point-to-point degree of exposure of the respective associated silver halide stratum; a polymeric layer dyeable by the dye image-providing materials; and a dimensionally stable transparent layer.

In view of the fact that the preferred dye image-providing materials comprise dyes which are silver halide developing agents, as stated above, for purposes of simplicity and clarity, the present invention will be further described hereinafter in terms of such dyes, without limitation of the invention to the illustrative dyes denoted, and, in addition the photographic film unit structure will be detailed hereinafter employing the last-mentioned preferred structural embodiment, without limitation of the invention to the preferred structure denoted.

The dye developers, as noted above, are compounds which contain, in the same molecule, both the chromophoric system of a dye and also a silver halide developing function. By "a silver halide developing function" is meant a grouping adapted to develop exposed silver halide. A preferred silver halide development function is a hydroquinonyl group. Other suitable developing functions include ortho-dihydroxyphenyl and ortho- and para-amino substituted hydroxyphenyl groups. In general, the development function includes a benzenoid developing function, that is, an aromatic developing group which forms quinonoid or quinone substances when oxidized.

The dye developers are preferably selected for their ability to provide colors that are useful in carrying out subtractive color photography, that is, the previously mentioned cyan, magenta and yellow. The dye developers employed may be incorporated in the respective silver halide emulsion or, in the preferred embodiment, in a separate layer behind the respective silver halide stratum. Specifically, the dye developer may, for example, be in a coating or layer behind the respective silver halide stratum and such a layer of dye developer may be applied by use of a coating solution containing about 0.5 to 8%, by weight, of the respective dye developer distributed in a film-forming natural, or synthetic, polymer, for example, gelatin, polyvinyl alcohol, and the like, adapted to be permeated by the chosen diffusion transfer fluid processing composition.

The silver halide strata comprising the multicolor photosensitive laminate preferably possess predominant spectral sensitivity to separate regions of the spectrum and each has associated therewith a dye which is a silver halide developing agent and is, most preferably, substantially soluble in the reduced form only at a first pH possessing, subsequent to processing, a spectral absorption range substantially complementary to the predominant sensitivity range of its associated emulsion.

In the preferred embodiment, each of the silver halide strata, and its associated dye, is separated from the remaining strata, and their associated dye, by separate alkaline solution permeable polymeric interlayers.

In such preferred embodiment of the invention, the silver halide strata comprises photosensitive silver halide dispersed in gelatin and are about 0.6 to 6 microns in thickness; the dye itself is dispersed in an aqueous alkaline solution polymeric binder, preferably gelatin, as a separate layer about 1 to 7 microns in thickness; the alkaline solution permeable polymeric interlayers, preferably gelatin, are about 1 to 5 microns in thickness; the dyeable polymeric layer is transparent and about 0.25 to 0.4 mil, in thickness; and each of the dimensionally stable opaque and transparent layers are alkaline solution impermeable, processing composition vapor permeable and about 2 to 6 mils. in thickness. It will be specifically recognized that the relative dimensions recited above may be appropriately modified, in accordance with the desires of the operator, with respect to the specific product to be ultimately prepared.

Although in point of fact, the dimensionally stable layers employed in the practice of the present invention may possess a vapor transmission rate of 1 or less gms/24 hrs./100 in.$^2$/mil., in a preferred embodiment of the present invention, the layers employed will possess a vapor transmission rate for the selected processing composition solvent averaging not less than about 100 gms./24 hrs./100 in.$^2$/mil., most preferably in terms of the preferred solvent, water, a vapor transmission rate averaging in excess of about 300 gms. of water/24 hrs./100 in.$^2$/mil., and may advantageously comprise a microporous polymeric film possessing a pore distribution which does not unduly interfere with the dimensional stability of the layers or, where required, the optical characteristics of such layers. Such pore distribution may comprise, for example, an average pore diameter of from $< \sim 20$ microns to $> \sim 100$ microns and a pore volume of $< \sim 3\%$ to $> \sim 7\%$.

In a particularly preferred embodiment of the present invention, the preferred solvent, water, may be employed in a weight/weight ratio of about 1:10 to 1:20 dye to water at a ratio of about 1:3 to 1:10 liquid permeable polymer to water and most preferably will be fabricated to comprise about 300 to 1300 mgs./ft.$^2$ liquid permeable polymeric binder material, about 200 to 400 mgs./ft.$^2$ dye and about 5000 mgs./ft.$^2$ water.

The dimensionally stable layers are designed so that there is no liquid flow through the layers while allowing the vapor of the processing composition solvent to pass by diffusion from the evaporating liquid body and the operational efficiency of the film unit is directly dependent upon the nature and quality of the vapor permeable membrane characteristics of the layers selected. The vapor transmission characteristics desired are directed to maximization of the rate at which the required quantity of processing solvent is effectively evacuated from the film unit subsequent to substantial dye transfer image formation by diffusion transfer processing, commensurate with maintaining the liquid impermeability and dimensional stability characteristics of the layers. Thus, the layers should possess the maximum vapor transmission capacity which permits the passage of processing composition solvent vapor, and any gas dissolved therein, at its vapor pressure, without allowing passage of fluid processing composition. The layers employed in accordance with the present invention therefor should be as thin as possible for solvent vapor transmission efficiency yet retain sufficient strength to provide stability to and resist chemical and physical degradation of the film unit under conditions of use.

In the preferred embodiment of the present invention's film unit for the production of a multicolor transfer image, the respective silver halide/dye developer units of the photo-sensitive element will be in the form of a tripack configuration which will ordinarily comprise a cyan dye developer/red-sensitive emulsion unit contiguous the dimensionally stable opaque layer, the yellow dye developer/blue-sensitive emulsion unit most distant from the opaque layer and the magenta dye developer/green-sensitive emulsion unit intermediate those units, recognizing that the relative order of such units may be varied in accordance with the desires of the operator.

Reference is now made to FIGS. 1 through 7 of the drawings wherein there is illustrated a preferred film unit of the present invention and wherein like numbers, appearing in the varous figures, refer to like components.

As illustrated in the drawings, FIG. 1 sets forth a perspective view of the film unit, designated 10, and each of FIGS. 2 through 7 illustrate diagrammatic cross-sectional views of film unit 10, along the stated section lines 2—2, 3—3, 5—5 and 7—7, during the various depicted stages in the performance of a photographic diffusion transfer process as detailed hereinafter.

Film unit 10 comprises rupturable container 11, retaining, prior to processing, aqueous processing composition 12, and photosensitive laminate 13 including, in order, dimensionally stable opaque layer 14, preferably an actinic radiation-opaque flexible sheet material; cyan dye developer layer 15; red-sensitive silver halide emulsion layer 16; interlayer 17; magenta dye developer layer 18; green-sensitive silver halide emulsion layer 19; interlayer 20; yellow dye developer layer 21; blue-sensitive silver halide emulsion layer 22; auxiliary layer 23, which may contain an auxiliary silver halide developing agent; image-receiving layer 24; spacer layer 25; neutralizing layer 26; and dimensionally stable transparent layer 27, preferably an actinic radiation transmissive flexible sheet material.

The structural integrity of laminate 13 may be maintained, at least in part, by the adhesive capacity exhibited between the various layers comprising the laminate at their opposed surfaces. However, the adhesive capacity exhibited at an interface intermediate image-receiving layer 24 and the silver halide emulsion layer next adjacent thereto, for example, image-receiving layer 24 and auxiliary layer 23 as illustrated in FIGS. 2 through 7, should be less than that exhibited at the interface between the opposed surfaces of the remainder of the layers forming the laminate, in order to facilitate distribution of processing solution 12 intermediate the stated imagereceiving layer 24 and the silver halide emulsion layer next adjacent thereto. The laminate's structural integrity may also be enhanced or provided, in whole or in part, by providing a binding member extending around, for example, the edges of laminate 13, and maintaining the layers comprising the laminate intact, except at the interface between layers 23 and 24 during distribution of processing composition 12 intermediate those layers. As illustrated in the figures, the binding member may comprise a pressure-sensitive tape 28 securing and/or maintaining the layers of laminate 13 together at its respective edges. Tape 28 will also act to maintain processing solution 12 intermediate image-receiving layer 24 and the silver halide emulsion layer next adjacent thereto, upon application of compressive pressure to pod 11 and distribution of its contents intermediate the stated layers. Under such circumstances, binder tape 28 will act to prevent leakage of fluid processing composition from the film unit's laminate during and subsequent to photographic processing.

Rupturable container 11 may be of the type shown and described in any of U.S. Pat. Nos. 2,543,181; 2,634,886; 3,653,732; 2,7723,051; 3,056,492; 3,056,491; 3,152,515; and the like. In general, such containers will comprise a rectangular blank of fluid- and air-impervious sheet material folded longitudinally upon itself to form two walls 29 which are sealed to one another along their longitudinal and end margins to form a cavity in which processing composition 12 is retained. The longitudinal marginal seal 30 is made weaker than the end seals 31 so as to become unsealed in response to the hydraulic pressure generated within the fluid contents 12 of the container by the application of compressive pressure to walls 29 of the container.

Figure 2:
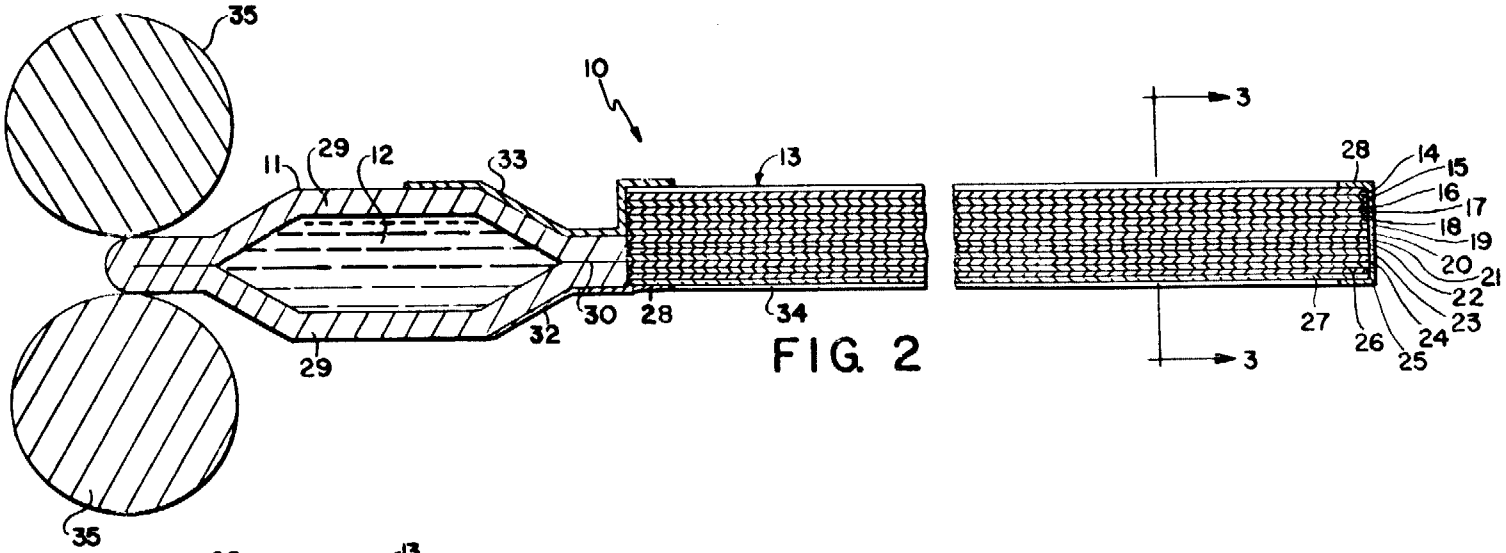
Figure 3:
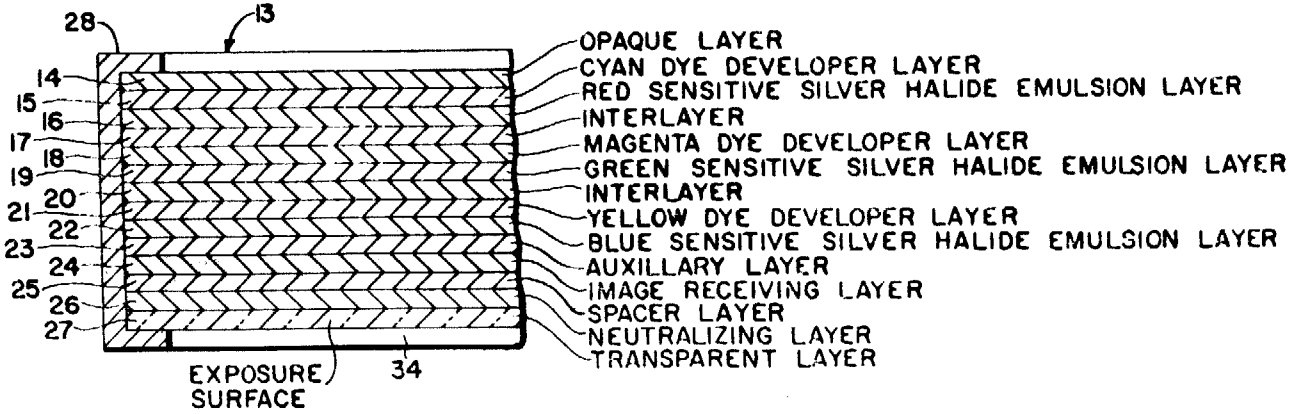
FIGS. 3, 5 and 7 are diagrammatic, further enlarged cross-sectional views of the film unit of FIGS. 2, 4 and 6, along section lines 3—3, 5—5 and 7—7, respectively, further illustrating, in detail, the arrangement of layers comprising the photosensitive laminate during the three illustrated stages of the transfer process.
Figure 4:
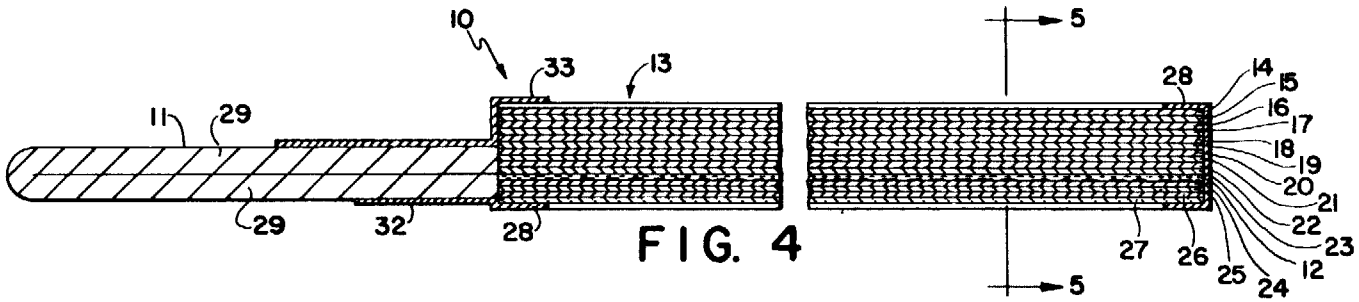
Figure 5:
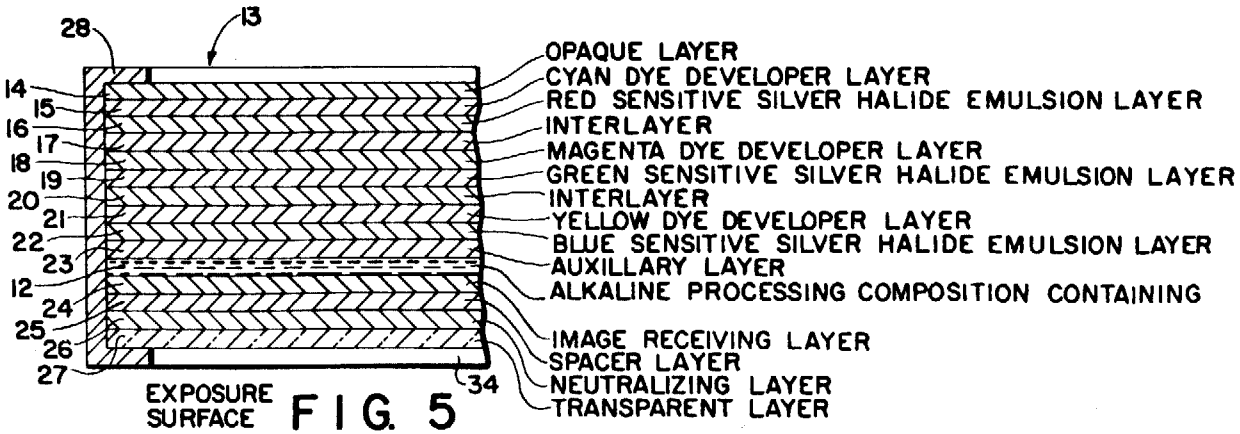
Figure 6:
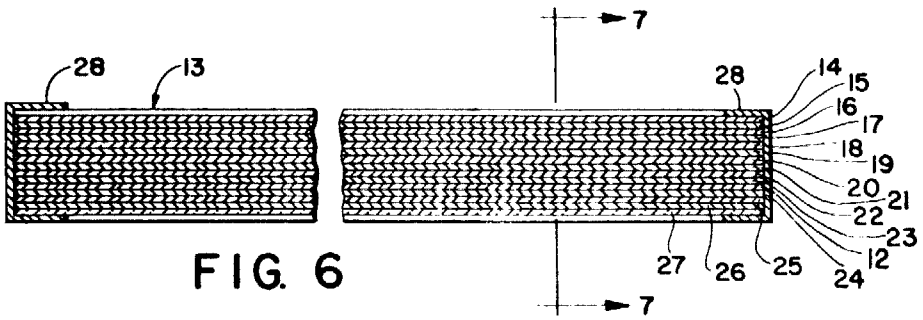
Figure 7:
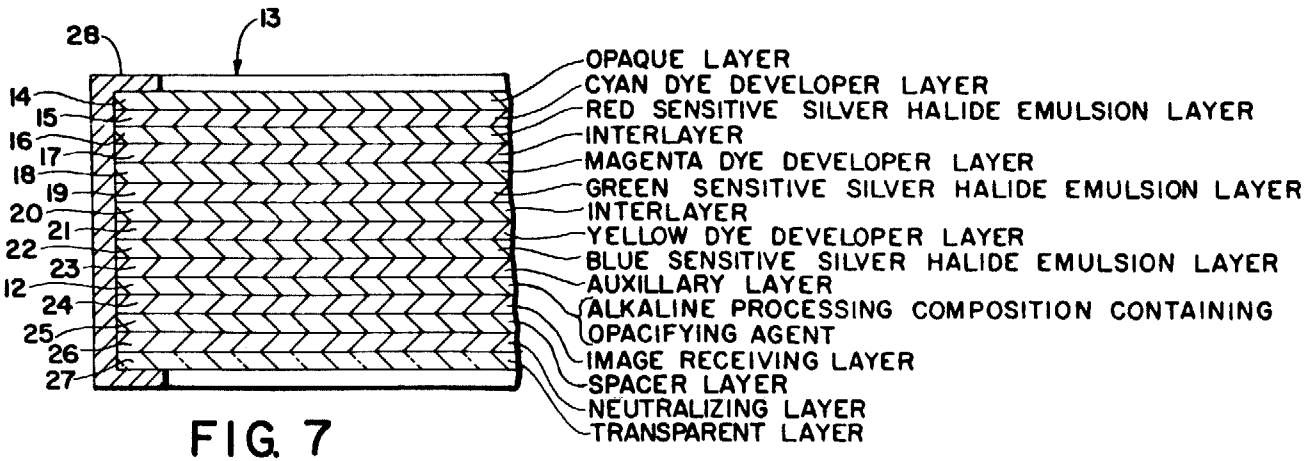

As illustrated in FIGS. 1, 2 and 3, container 11 is fixedly positioned and extends transverse a leading edge of photosensitive laminate 13 whereby to effect unidirectional discharge of the container's contents 12 between image-receiving layer 24 and the stated layer next adjacent thereto, upon application of compressive force to container 11. Thus, container 11, as illustrated in FIG. 2, is fixedly positioned and extends transverse a leading edge of laminate 13 with its longitudinal marginal seal 30 directed toward the interface between image-receiving layer 24 and auxiliary layer 23. As shown in FIGS. 1, 2 and 4, container 11 is fixedly secured to laminate 13 by extension 32 of tape 28 extending over a portion of one wall 29 of the container, in combination with a separate retaining member such as illustrated retaining tape 33 extending over a portion of laminate 13's surface generally equal in area to about that covered by tape 28.

As illustrated in FIGS. 1, 2 and 4, extension flap 32 of tape 28 is preferably of such area and dimensions that upon, for example, manual separation of container 11 and tape 33, subsequent to distribution of processing composition 12, from the remainder of film unit 10, flap 32 may be folded over the edge of laminate 13, previously covered by tape 33, in order to facilitate maintenance of the laminate's structural integrity, for example, during the flexations inevitable in storage and use of the processed film unit, and to provide a suitable mask or frame, for viewing of the transfer image through the picture viewing area of transparent layer 27.

The fluid contents of the container preferably comprise the viscosity increasing polymer, an aqueous alkaline solution having a pH and solvent concentration at which the dye developers are soluble and diffusible and a titanium dioxide pigment and at least one optical filter agent at a pH above the pKa of such agent in a quantity sufficient, upon distribution, effective to provide a layer exhibiting optical transmission density $> \sim 6.0$ and optical reflection density $< \sim 1.0$ to prevent exposure of photosensitive silver halide emulsion layers 16, 19 and 22 by actinic radiation incident on dimensionally stable transparent layer 27 during processing in the presence of such radiation and to afford immediate viewing of dye image formation in image-receiving layer 24 during and subsequent to dye transfer image formation. Accordingly, the film unit may be processed, subsequent to distribution of the composition, in the presence of such radiation, in view of the fact that the silver halide emulsion or emulsions of laminate are appropriately protected by incident radiation, at one major surface of the opaque processing composition and at the remaining major surface by the dimensionally stable opaque layer. If the illustrated binder tapes are also opaque, edge leakage of actinic radiation incident on the emulsion or emulsions will also be prevented.

The optical fiber agent selected should be one exhibiting, at a pH above its pKa, maximum spectral absorption of radiation at the wavelengths to which the film unit's photosensitive silver halide layer or layers are sensitive and should be substantially immobile or nondiffusible within the pigment dispersion, during performance of its radiation filtration function, in order to maintain and enhance the optical integrity of the dispersion as a radiation filter unit functioning in accordance with the present invention, and to prevent its diffusion into and localized concentration within the image-receiving layer thereby decreasing the efficiency of the reflecting pigment dispersion as a background against which image formation may be immediately viewed, during the initial stages in the diffusion transfer processing of the film unit, by filter agent absorption of dispersion reflected visible radiation prior to reduction in the environmental pH below the pKa of the agent. Commensurate with the spectral sensitivity range of the associated silver halide layer or layers, the optical filter agent selected may comprise one or more filter dyes possessing absorption complementary to such silver halide layers in order to provide effective protection against physical fog providing radiation during processing. Recognizing that the filter agent absorption will derogate from image-viewing characteristics by contaminating reflecting pigment background, the selected agents should be those exhibiting major spectral absorption at the pH at which processing is effected and minimal absorption at a pH below that which obtains during transfer image formation. Accordingly, the selected optical filter agent or agents should possess a pKa below that of the processing pH and above that of the environmental pH subsequent to transfer image formation, and will be preferably selected for employment in the minimum concentration necessary to provide an optical transmission density $> \sim 6.0$, at wavelengths at which the silver halide layer is maximally responsive, and an optical reflection density $< \sim 1.0$ at such wavelengths.

As specific examples of such pH-sensitive optical filter agents adapted for employment in the practice of the present invention, reference is directed to the agents set forth in aforementioned copending U.S. Pat. application Ser. No. 43,782, filed June 5, 1970, incorporated herein by reference.

In general, preferred agents, both opacifying and filter, are those which remain immobile within their respective compositions during and subsequent to photographic processing and particularly those which comprise insoluble and nondiffusible materials.

As disclosed in the previously cited patents, the liquid processing composition referred to for effecting multicolor diffusion transfer processes comprises at least an aqueous solution of an alkaline material, for example, diethylamine, sodium hydroxide or sodium carbonate and the like, and preferably possessing a pH in excess of 12.

In the performance of a diffusion transfer multicolor process employing film unit 10, the unit is exposed to radiation, actinic to photosensitive laminate 13, incident on the laminate's exposure surface, as illustrated in FIG. 3.

Subsequent to exposure, as illustrated by FIGS. 2 and 4, film unit 10 is processed by being passed through opposed suitably gapped rolls 35 in order to apply compressive pressure to frangible container 11 and to effect rupture of longitudinal seal 30 and distribution of alkaline processing composition 12, possessing titanium dioxide pigment and optical filter agent at a pH above the pKa of the filter agent and a pH at which the cyan, magenta and yellow dye developers are soluble and diffusible as a function of the point-to-point degree of exposure of red-sensitive silver halide emulsion layer 16, green-sensitive silver halide emulsion layer 19 and blue-sensitive silver halide emulsion layer 22, respectively, intermediate reflecting agent precursor layer 25 and auxiliary layer 23.

Alkaline processing composition 12 permeates emulsion layers 16, 19 and 22 to initiate development of the latent images contained in the respective emulsions. The cyan, magenta and yellow dye developers, of layers 15, 18 and 21, are immobilized, as a function of the development of their respective associated silver halide emulsions, preferably substantially as a result of their conversion from the reduced form to their relatively insoluble and nondiffusible oxidized form, thereby providing imagewise distributions of mobile, soluble and diffusible cyan, magenta and yellow dye developer, as a function of the point-to-point degree of their associated emulsions' exposure. At least part of the imagewise distributions of mobile cyan, magenta and yellow dye developer transfers, by diffusion, to dyeable polymeric layer 24 to provide a multicolor dye transfer image to that layer which is viewable against the background provided by the reflecting pigment present in processing composition residuum 12 masking cyan, magenta and yellow dye developer remaining associated with blue-sensitive emulsion layer 22, green-sensitive emulsion layer 19 and red-sensitive emulsion layer 16. Subsequent to substantial transfer image formation, a sufficient portion of the ions comprising aqueous alkaline processing composition 12 transfer, by diffusion, through permeable polymeric reception layer 24, permeable spacer layer 25 to polymeric neutralizing layer 26 whereby the environmental pH of the system decreases as a function of neutralization to a pH at which the cyan, magenta and yellow dye developers, in the reduced form, are substantially nondiffusible to thereby provide a stable multicolor dye transfer image and discharge of the pH-sensitive optical filter agent by reduction of the pH substantially below the pKa of such agent to thereby provide maximum reflectivity in terms of the pigment concentration present.

The alkaline solution component of the processing composition, positioned intermediate the photosensitive element and the image-receiving layer, thus permeates the emulsions to initiate development of the latent images contained therein. The respective associated dye developers are immobilized or precipitated in exposed areas as a consequence of the development of the latent images. The immobilization is apparently, at least in part, due to a change in the solubility characteristics of dye developer upon oxidation and especially as regards its solubility in alkaline solutions. It may also be due in part to a tanning effect on the emulsion by oxidized developing agent, and in part to a localized exhaustion of alkali as a result of development. In unexposed and partially exposed areas of the emulsions, the associated dye developer is diffusible and thus provides an imagewise distribution of unoxidized dye developer dissolved in the liquid processing composition, as a function of the point-to-point degree of exposure of the silver halide emulsion. At least part of this imagewise distribution of unoxidized dye developer is transferred, by imbibition, to a superposed image-receiving layer or element, said transfer substantially excluding oxidized dye developer. The image-receiving element receives a depthwise diffusion, from the developed emulsion, of unoxidized dye developer without appreciably disturbing the imagewise distribution thereof to provide the reversed or positive color image of the developed image.

Subsequent to distribution of processing composition 12, container 11 may be manually dissociated from the remainder of the film unit, as described above, to provide the product illustrated in FIG. 6.

It will be noted that the liquid processing composition employed may contain an auxiliary or accelerating developing agent, such as p-methylaminophenol, 2,4-diaminophenol, p-benzylaminophenyl, hydroquinone, toluhydroquinone, phenylhydroquinone, 4'-methylphenylhydroquinone, etc. It is also contemplated to employ a plurality of auxiliary or accelerating developing agents, such as a 3-pyrazolidone developing agent and a benzenoid developing agent, as disclosed in U.S. Pat. No. 3,039,869, issued June 19, 1962. As examples of suitable combinations of auxiliary developing agents, mention may be made of 1-phenyl-3-pyrazolidone in combination with p-benzylaminophenol and 1-phenyl-3-pyrazolidone in combination with 2,5-bis-ethylenimino-hydroquinone. Such auxiliary developing agents may be employed in the liquid processing composition or they may be initially incorporated, at least in part, in any one or more of the silver halide emulsion strata, the strata containing the dye developers, the interlayers, the overcoat layer, the image-receiving layer, or in any other auxiliary layer, or layers, of the film unit. It may be noted that at least a portion of the dye developer oxidized during development may be oxidized and immobilized as a result of a reaction, e.g., an energy-transfer reaction, with the oxidation product of an oxidized auxiliary developing agent, the latter developing agent being oxidized by the development of exposure silver halide. Such a reaction of oxidized developing agent with unoxidized dye developer would regenerate the auxiliary developing agent for further reaction with the exposed silver halide.

In addition, development may be effected in the presence of an onium compound, particularly a quaternary ammonium compound, in accordance with the processes disclosed in U.S. Pat. No. 3,173,786, issued Mar. 16, 1965.

It will be apparent that the relative proportions of the agents of the diffusion processing composition may be altered to suit the requirements of the operator. Thus, it is within the scope of this invention to modify the herein described developing compositions by the substitution of preservatives, alkalies, etc., other than those specifically mentioned, provided that the pH of the composition is initially at the first pH and solvent concentration required. When desirable, it is also contemplated to include, in the developing composition, components such as restrainers, accelerators, etc. Similarly, the concentration of various components may be varied over a wide range and when desirable adaptable components may be disposed in the photosensitive element, prior to exposure, in a separate permeable layer of the photo-sensitive element and/or in the photosensitive emulsion.

In all examples of this specification, percentages of components are given by weight unless otherwise indicated.

An extensive compilation of specific dye developers particularly adapted for employment in photographic diffusion transfer processes is set forth in aforementioned U.S. Pat. No. 2,983,606 and in the various copending U.S. applications referred to in that patent, especially in the table of U.S. applications incorporated by reference into the patent as detailed in column 27. As examples of additional U.S. patents detailing specific dye developers for photographic transfer process use, mention may also be made of U.S. Pat. Nos. 2,983,605; 2,992,106; 3,047,386; 3,076,808; 3,076,820; 3,077,402; 3,126,280; 3,131,061; 3,134,762; 3,134,765; 3,135,604; 3,135,605; 3,135,606; 3,135,734; 3,141,772; 3,142,565; and the like.

As additional examples of synthetic, film-forming, permeable polymers particularly adapted to retain dispersed dye developer, mention may be made of nitrocarboxymethyl cellulose, as disclosed in U.S. Pat. No. 2,992,104; an acylamidobenzene sulfo ester of a partial sulfobenzal of polyvinyl alcohol, as disclosed in U.S. Pat. No. 3,043,692; polymers of N-alkyl-$\alpha,\beta$-unsaturated carboxamides and copolymers of N-alkyl-$\alpha,\beta$-carboxamides with N-hydroxyalkyl-$\alpha,\beta$-unsaturated carboxamides, as disclosed in U.S. Pat. No. 3,069,263; copolymers of vinylphthalimide and $\alpha,\beta$-unsaturated carboxylic acids, as disclosed in U.S. Pat. No. 3,061,428; copolymers of N-vinylpyrrolidones and $\alpha,\beta$-unsaturated carboxylic acids and terpolymers of N-vinylpyrrolidones, $\alpha,\beta$-unsaturated carboxylic acids and alkyl esters of $\alpha,\beta$-unsaturated carboxylic acids, as disclosed in U.S. Pat. No. 3,044,873; copolymers of N,N-dialkyl-$\alpha,\beta$-unsaturated carboxamides with $\alpha,\beta$-unsaturated carboxylic acids, the corresponding amides of such acids, and copolymers of N-aryl-and N-cycloalkyl-$\alpha,\beta$-unsaturated carboxamides with $\alpha,\beta$-unsaturated carboxylic acids, as disclosed in U.S. Pat. No. 3,069,296; and the like.

In addition to conventional techniques for the direct dispersion of a particulate solid material in a polymeric, or colloidal, matrix such as ball-milling and the like techniques, the preparation of the dye developer dispersion may also be obtained by dissolving the dye in an appropriate solvent, or mixture or solvents, and the resultant solution distributed in the polymeric binder, with optional subsequent removal of the solvent, employed, as, for example, by vaporization where the selected solvent, or solvents, possesses a sufficiently low boiling point or washing where the selected solvent, or solvents, possesses a sufficiently high differential solubility in the wash medium, for example, water, when measured against the solubility of the remaining composition components, and/or obtained by dissolving both the polymeric binder and dye in a common solvent.

For further detailed treatment of solvent distribution systems of the types referred to above, and for an extensive compilation of the conventional solvents traditionally employed in the art to effect distribution of photographic color-providing materials in polymeric binders, specifically for the formation component layers of photographic film units, reference may be made to U.S. Pat. Nos. 2,269,158; 2,322,027; 2,304,939; 2,304,940; 2,801,171; and the like.

Although the invention has been discussed in detail throughout employing dye developers, the preferred imageproviding materials, it will be readily recognized that other, less preferred, image-providing materials may be substituted in replacement of the preferred dye developers in the practice of the invention. For example, there may be employed dye image-forming materials such as those disclosed in U.S. Pat. Nos. 2,647,049; 2,661,293; 2,698,244; 2,698,798; 2,802,735; 3,148,062; 3,227,550; 3,227,551; 3,227,552; 3,227,554; 3,243,294; 3,330,655; 3,347,671; 3,352,672; 3,364,022; 3,443,939; 3,443,940; 3,443,941; 3,443,943; etc., wherein color diffusion transfer processes are described which employ color coupling techniques comprising, at least in part, reacting one or more color developing agents and one or more color formers or couplers to provide a dye transfer image to a superposed image-receiving layer and those disclosed in U.S. Pat. No. 2,774,668 and 3,087,817, wherein color diffusion transfer processes are described which employ the imagewise differential transfer of complete dyes by the mechanisms therein described to provide a transfer dye image to a contiguous image-receiving layer, and thus including the employment of image-providing materials in whole or in part initially insoluble or nondiffusible as disposed in the film unit which diffuse during processing as a direct or indirect function of exposure.

For the production of the photosensitive gelatino silver halide emulsions employed to provide the film unit, the silver halide crystals may be prepared by reacting a water-soluble silver salt, such as silver nitrate, with at least one water-soluble halide, such as ammonium, potassium or sodium bromide, preferably together with a corresponding iodide, in an aqueous solution of a peptizing agent such as a colloidal gelatin solution; digesting the dispersion at an elevated temperature, to provide increased crystal growth; washing the resultant water-soluble salts by chilling the dispersion, noodling the set dispersion, and washing the noodles with cold water, or alternatively, employing any of the various floc systems, or procedures, adapted to effect removal of undesired components, for example, the procedures described in U.S. Pat. Nos. 2,614,928; 2,614,929; 2,728,662; and the like; after-ripening the dispersion at an elevated temperature in combination with the addition of gelatin and various adjuncts, for example, chemical sensitizing agents of U.S. Pat. Nos. 1,574,944; 1,623,499; 2,410,689; 2,597,856; 2,597,915; 2,487,850; 2,518,698; 2,521,926; and the like; all according to the traditional procedures of the art, as described in Neblette, C. B., *Photography Its Materials and Processes*, 6th Ed., 1962.

Optical sensitization of the emulsion's silver halide crystals may be accomplished by contact of the emulsion composition with an effective concentration of the selected optical sensitizing dyes dissolved in an appropriate dispersing solvent such as methanol, ethanol, acetone, water, and the like; all according to the traditional procedures of the art, as described in Hammer, F. M., *The Cyanine Dyes and Related Compounds*.

Additional optional additives, such as coating aids, hardeners, viscosity-increasing agents, stabilizers, preservatives, and the like, for example, those set forth hereinafter, also may be incorporated in the emulsion formulation, according to the conventional procedures known in the photogaphic emulsion manufacturing art.

The photoresponsive material of the photographic emulsion will, as previously described, preferably comprise a crystal of silver, for example, one or more of the silver halides such as silver chloride, silver iodide, silver bromide, or mixed silver halides such as silver chlorobromide, silver chloroiodobromide or silver iodobromide, of varying halide ratios and varying silver concentrations.

As the binder for the respective emulsion strata, the aforementioned gelatin may be, in whole or in part, replaced with some other colloidal material such as albumin; casein; or zein; or resins such as a cellulose derivatives, as described in U.S. Pat. Nos. 2,322,085 and 2,327,808; polyacrylamides, as described in U.S. Pat. No. 2,541,474; vinyl polymers such as described in an extensive multiplicity of readily available U.S. and foreign patents.

In preferred embodiments of the present invention, the photosensitive silver halide emulsions employed will be emulsions adapted to provide a Diffusion Transfer Process Exposure Index $> \sim 50$, which Index indicates the correct exposure rating of a diffusion transfer color process at which an exposure meter, calibrated to the ASA Exposure Index, must be set in order that it give correct exposure data for producing color transfer prints of satisfactorily high quality. The Diffusion Transfer Process Exposure Index is based on a characteristic H&D curve relating original exposure of the photosensitive silver halide emulsions to the respective curve densities forming the resultant transfer image. Thus, the Diffusion Transfer Exposure Index is based on the exposure to which the photosensitive silver halide emulsions, for use in color diffusion transfer processes, must be subjected in order to obtain an acceptable color transfer image by that process and is a direct guide to the exposure setting to be entered in a camera in order to obtain proper exposure of the film unit.

Although the preceding description of the invention has been couched in terms of the preferred photosensitive component construction wherein at least two selectively sensitized photosensitive strata are in contiguous coplanar relationship and, specifically in terms of the preferred tripack type structure comprising a red-sensitive silver halide emulsion stratum, a green-sensitive silver halide emulsion stratum and a blue-sensitive silver halide emulsion stratum having associated therewith, respectively a cyan dye developer, a magenta dye developer and a yellow dye developer, the photosensitive component of the film unit may comprise at least two sets of selectively sensitized minute photosensitive elements arranged in the form of a photosensitive screen wherein each of the minute photosensitive elements has associated therewith, for example, an appropriate dye developer in or behind its respective silver halide emulsion portion. In general, a suitable photosensitive screen will comprise minute red-sensitized emulsion elements, minute green-sensitized emulsion elements and minute blue-sensitized emulsion elements arranged in side-by-side relationship in a screen pattern and having associated therewith, respectively, a cyan, a magneta and a yellow dye developer.

The present invention also includes the employment of a black dye developer and the use of a mixture of dye developers adapted to provide a black-and-white transfer image, for example, the employment of dye developers of the three subtractive colors in an appropriate mixture in which the quantities of the dye developers are proportioned such that the colors combine to provide black.

Where in the specification, the expression "positive image" has been used, this expression should not be interpreted in a restrictive sense since it is used primarily for purposes of illustration, in that it defines the image produced on the image-carrying layer as being reversed, in the positive-negative sense, with respect to the image in the photosensitive emulsion layers. As an example of an alternative meaning for positive image, assume that the photosensitive element is exposed to actinic light through a negative transparency. In this case, the latent image in the photosensitive emulsion layers will be a positive and the dye image produced on the image-carrying layer will be a negative. The expression positive image is intended to cover such an image produced on the image-carrying layer.

It will be recognized that, by reason of the preferred film unit's structural parameters, the transfer image formed upon directed exposure of the film unit to a selected subject and processing, will be a geometrically reversed image of the subject. Accordingly, to provide transfer image formation geometrically nonreversed, exposure of such film unit should be accomplished through an image reversing optical system such a camera processing an image reversing optical system.

In addition to the described essential layers, it will be recognized that the film unit may also contain one or more subcoats or layers, which, in turn, may contain one or more additives such as plasticizers, intermediate essential layers for the purpose, for example, of improving adhesion, and that any one or more of the described layers may comprise a composite of two or more strata of the same, or different, components and which may be contiguous, or separated from, each other, for example, two or more neutralizing layers or the like, one of which may be disposed intermediate the cyan dye image-forming component retaining layer and the dimensionally stable opaque layer.

Since certain changes may be made in the above product and process without departing from the scope of the invention herein involved, it is intended that all matter contained in the above description or shown in the accompanying drawings shall be interpreted as illustrative and not in a limiting sense.

What is claimed is:

1. In a photographic dye diffusion transfer film unit which comprises first and second dimensionally stable liquid impermeable layers; and, intermediate said liquid impermeable layers, a photosensitive silver halide layer having associated therewith a diffusion transfer dye image-forming material adapted to provide an imagewide distribution of diffusable dye as a function of photoexposure and development of said silver halide layer carried by one of said liquid impermeable layers; a dyeable layer adapted to receive dye diffusing thereto, said dyeable layer carried by one of said liquid impermeable layers; and a rupturable container retaining an alkaline processing composition positioned extending transverse an edge of the film unit to effect, upon application of compressive pressure to said container, discharge of said container's contents intermediate one of said liquid impermeable layers and said silver halide layer or intermediate said dyeable layer and said silver halide layer; said processing composition adapted to initiate development of latent images contained in said silver halide layer resultant from photoexposure of said silver halide layer; the improvement which comprises the inclusion in said processing composition of carboxymethyl hydroxyethyl cellulose at a level of about 0.1–10%, by weight.

2. A film unit as defined in claim 1, wherein said dye image-forming material is a dye developer.

3. A film unit as defined in claim 1 wherein said dyeable layer is carried on one of said liquid impermeable layers and said silver halide layer is carried on the other of said liquid impermeable layers and said processing composition is adapted to be distributed intermediate said dyeable layer and said silver halide layer.

4. A film unit as defined in claim 1 wherein said film unit is an integral film unit adapted to be maintained intact subsequent to processing and at least one of said liquid-impermeable polymeric layers is transparent and which further includes means for masking residual dye image-forming material retained in association with said silver halide layer subsequent to processing.

5. A film unit as defined in claim 4 wherein said processing composition includes titanium dioxide.

6. A film unit as defined in claim 1 wherein said dyeable layer is adapted to be detached from film unit subsequent to dye image formation therein.

7. A composite photographic film unit which comprises a plurality of sequential layers including a first dimensionally stable layer; a photosensitive silver halide layer having associated therewith dye developer image-forming material which is processing composition soluble and diffusible at a first pH as a function of the point-to-point degree of silver halide layer exposure to incident actinic radiation; a layer adapted to receive solubilized dye developer diffusing thereto; a second dimensionally stable layer transparent to radiation actinic to the silver halide layer; a rupturable container retaining an alkaline processing composition positioned extending transverse an edge of the film unit to effect, upon application of compressive pressure to said container, discharge of said container's processing composition contents intermediate said layer adapted to receive dye developer image-forming material and said photosensitive silver halide layer, said processing composition possessing a pH at which said dye developer image-forming material is soluble and diffusible as a function of the point-to-point degree of said photosensitive silver halide layer's exposure to incident actinic radiation, means adapted to mask dye developer image-forming material associated with the photosensitive silver halide layer, intermediate said photosensitive silver halide layer and said layer adapted to receive dye developer diffusing thereto, and 0.1–10%, by weight, of a viscosity increasing polymer comprising carboxymethyl hydroxyethyl cellulose, said film unit adapted to be maintained intact subsequent to processing.

8. A film unit as defined in claim 7 wherein said processing composition includes titanium dioxide pigment in a ratio of 1 to 10 grams of titanium dioxide per 0.1 gram of polymer.

9. A film unit as defined in claim 7 wherein said processing composition includes an alkali metal hydroxide in an amount sufficient to provide a pH in excess of 13.

10. A process for providing a photographic diffusion transfer dye image which comprises, in combination, the steps of:

a. exposing to incident electromagnetic radiation a composite photographic film unit which comprises a plurality of sequential layers including a first dimensionally stable layer; a photosensitive silver halide layer having associated therewith dye developer which is processing composition soluble and diffusible at a first pH as a function of the point-to-point degree of silver halide layer exposure to incident actinic radiation; a layer adapted to receive solubilized dye developer diffusing thereto; a second dimensionally stable layer transparent to radiation actinic to the silver halide layer; a rupturable container retaining an alkaline processing composition possessing said first pH at which said dye developer is soluble and diffusible and 0.1–10%, by weight, of a viscosity increasing polymer comprising carboxymethyl hydroxyethyl cellulose and titanium dioxide pigment in a ratio of 1 to 10 grams of titanium dioxide per 0.1 grams of polymer, said rupturable container positioned and extending transverse an edge of the photosensitive element to effect unidirectional discharge of the container's processing composition intermediate the layer adapted to receive the dye developer and the silver halide emulsion layer next adjacent thereto;

b. effecting discharge of the contents of said rupturable container intermediate said layer adapted to receive the dye developer and the next adjacent silver halide layer; forming thereby a layer of viscosity increasing polymer and titanium dioxide therebetween;

c. effecting thereby development of said silver halide layers; and d. forming thereby an imagewise distribution of mobile dye developer which is transferred, at least in part, by diffusion image-forming material;

e. transferring, by diffusion, at least a portion of the imagewise distribution of mobile dye image-forming material to the layer adapted to receive dye developer diffusing thereto provide a dye image in terms of the imagewise distribution; and f. subsequent to substantial transfer of mobile dye developer to the layer adapted to receiving dye developer diffusing thereto, effecting reduction of the pH of the film unit by means of acid disposed within said film unit to thereby convert the pH of the film unit from the first pH to a second pH at which the dye developer is substantially nondiffusible and g. maintaining the film unit intact subsequent to processing.

11. A process as defined in claim 10 wherein said acid is disposed in a polymeric neutralizing layer of said film unit.

* * * * *